United States Patent [19]

Asick

[11] 4,415,223

[45] Nov. 15, 1983

[54] INTERLOCKING CRIMP SLEEVE AND METHOD OF SECURING TO CONNECTOR

[75] Inventor: John C. Asick, Harrisburg, Pa.

[73] Assignee: AMP Incorporated, Harrisburg, Pa.

[21] Appl. No.: 270,036

[22] Filed: Jun. 3, 1981

[51] Int. Cl.[3] ..... H01R 4/20; H01R 43/04

[52] U.S. Cl. ..... 339/276 R; 29/862; 29/753; 174/89; 339/143 R; 339/223 R

[58] Field of Search ..... 29/862, 753, 564.1, 29/149.5 R; 227/83, 85; 428/578; 339/276 SF, 276 T, 143 R, 233 R; 174/89; 72/402

[56] References Cited

U.S. PATENT DOCUMENTS

| | | | |
|---|---|---|---|
| 368,987 | 8/1887 | Wheeler | 339/276 T |
| 1,687,574 | 10/1928 | Liss | 339/276 T |
| 2,283,918 | 5/1942 | Dekome | 29/149.5 R |
| 2,293,491 | 8/1942 | Cox | 29/521 |
| 2,335,292 | 11/1943 | Messenger | 428/578 |
| 2,748,456 | 6/1956 | Berg | 29/874 X |
| 2,762,117 | 9/1956 | Houck | 29/149.5 R X |
| 2,802,195 | 8/1957 | Martines | 339/276 T |
| 3,099,238 | 7/1963 | Jones | 29/524 X |
| 3,293,355 | 12/1966 | Gropp et al. | 174/84 C |
| 3,641,647 | 6/1970 | Balmer | 227/83 |
| 3,724,054 | 4/1973 | Fernald et al. | 29/862 X |
| 3,753,279 | 8/1973 | Eppler | 29/753 X |

*Primary Examiner*—Howard N. Goldberg
*Assistant Examiner*—Carl J. Arbes
*Attorney, Agent, or Firm*—Russell J. Egan

[57] ABSTRACT

An interlocking crimp sleeve is disclosed for application to a terminated connector so as to apply an annular crimp securing the cable and particularly the cable shielding thereto. The subject sleeve is formed as an initially flat strip of metal stock having pre-formed opposite ends of an interlocking configuration. The strip is applied to the connector by bending around the electrical cable, engaging the interlocking end configurations and crimping the thus formed substantially cylindrical sleeve to provide the desired clamping and compression of the cable and engagement between the cable shield and connector shield.

6 Claims, 7 Drawing Figures

INTERLOCKING CRIMP SLEEVE AND METHOD OF SECURING TO CONNECTOR

The present invention relates to an interlocking crimp sleeve which can be applied to a terminated electrical connector to provide annular crimping securing a cable and/or cable shielding to the connector.

It is often necessary to repair electrical connectors but this frequently can be a difficult job when a portion of the connector including a crimped ferrule or the like. An example may be found in U.S. Pat. No. 3,010,183. It will be appreciated that the metal ferrule 40 must be positioned on the cable prior to assembly of the connection. Replacement of the ferrule would require assembly sufficient to gain access to the free end of the cable. Such ferrules are quite commonly used with shielded connectors wherein it is necessary to provide an electrical and mechanical engagement between shielding of a cable and a shielded portion of a connector. An example of this can be found in my co-pending U.S. Pat. No. 4,337,989 in which a metal shell is applied to a known electrical connector with portions of the shell forming a sleeve which is inserted inside the braid of a shielded cable. The braid is then stretched over the sleeve portion and must be crimped thereto to provide the desired shielding effect. Normally an annular crimp ferrule is applied to the cable prior to the terminating operation but this is quite impossible when effecting a repair. In order to use a replacement annular crimp ferrule it would be necessary to disassemble all of the electrical terminals, not just the one being repaired, and remove the entire connector and old crimp ferrule from the cable, apply a new crimp ferrule and reinsert all of the terminals into the appropriate cavities of the connector housing. Such an operation clearly would be tedious, time consuming, and extremely expensive from a labor standpoint.

According to the invention therefore, an interlocking crimp sleeve is characterized in that it is stamped from a strip of stock material and subsequently applied to the cable of a previously terminated electrical connector. The subject crimp sleeve is formed as a strip of metal material having an interlocking projection and recess profiles on the opposite ends thereof. The strip is applied by initially curling it around the cable, engaging the interlocking end profiles, and crimping the thus formed substantially cylindrical member in conventional fashion.

It is therefore an object of the present invention to produce a crimp sleeve which is formed as a strip of metal with interlocking ends and can be applied to a previously terminated electrical connector in rapid and easily facilitated manner.

Figure 1:
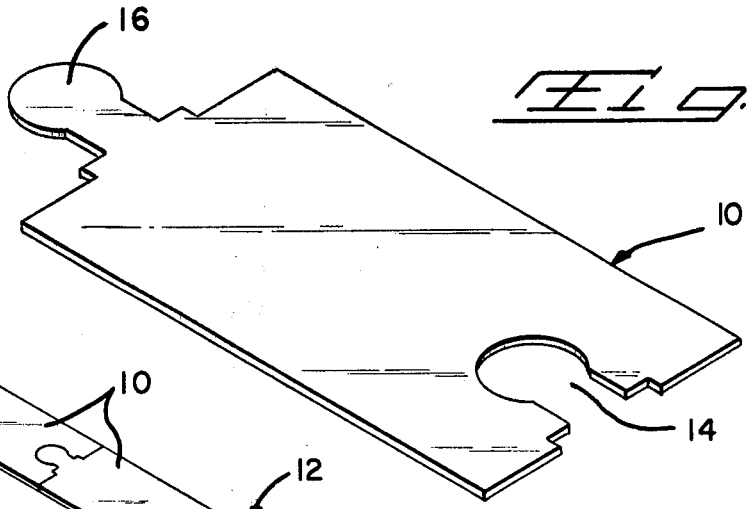
Figure 1A:
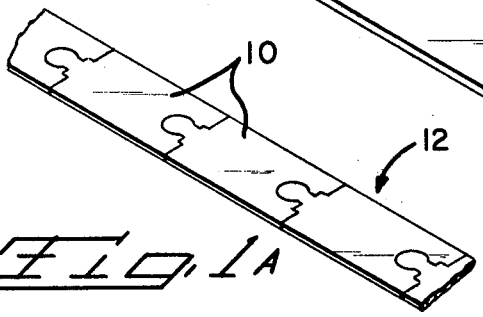
Figure 2:
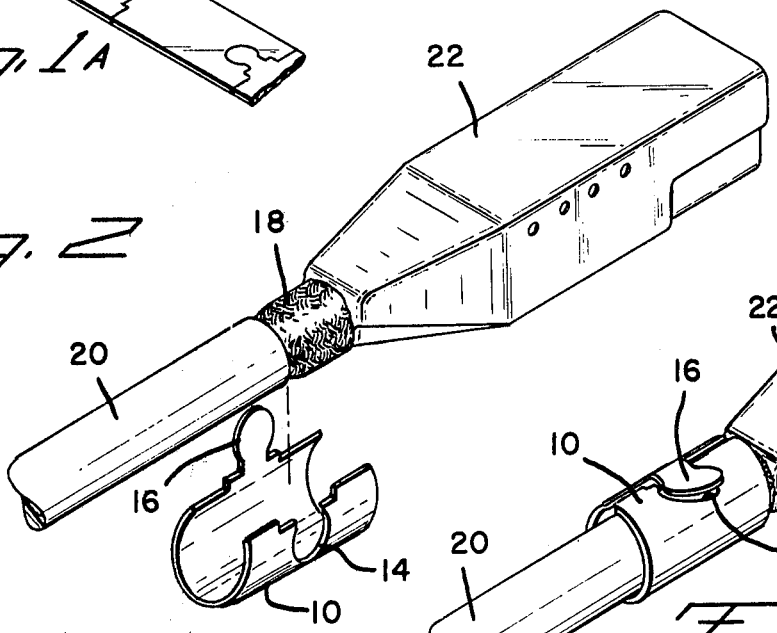
Figure 3:
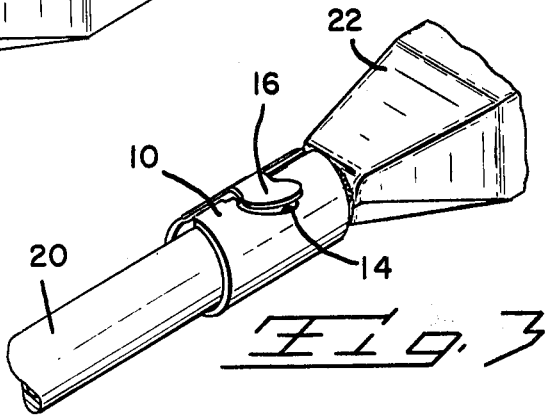
Figure 4:
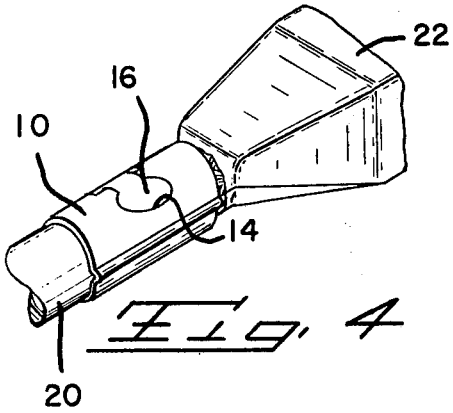
Figure 5:
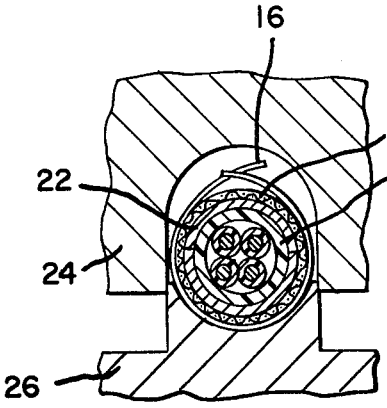
Figure 6:
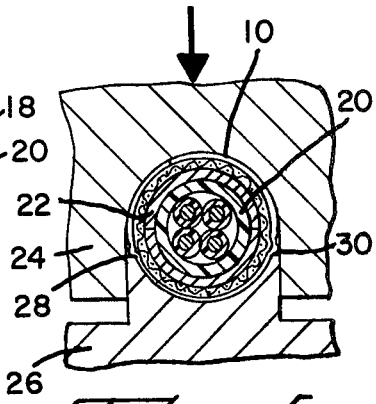

An embodiment of the present invention will now be described by way of example with reference to the accompanying drawings, in which:

FIG. 1 is a perspective view of a single crimp sleeve according to the present invention in the initial flat condition as stamped from a web of metal;

FIG. 1*a* is a perspective view of a strip of crimp sleeves formed in accordance with the present invention;

FIGS. 2, 3, and 4 show the sequential steps of applying the subject crimp sleeve to a shielded electrical connector terminated by a shielded cable;

FIGS. 5 and 6 are transversed sections through the crimp sleeve, connector, and cable showing the steps of crimping of the subject crimp sleeve to the cable and connector of FIGS. 2 to 4.

The interlocking crimp sleeve 10 is shown in FIG. 1 as it would appear after being separated from a strip of crimp rings 12 shown in FIG. 1*a*. The strip 12 is formed of a soft metal, such as copper, and is of such dimensions as would be necessary to make the appropriate size sleeve. The term soft refers to a range of 0 to 2 on a scale where 0 is annealed, 2 is $\frac{1}{4}$ hard or soft, 4 is $\frac{1}{2}$ hard or medium, 6 is $\frac{3}{4}$ hard, 8 is full hard and 12 is tempered or heat treated. At a first end of each ring 10 there is an interlocking recess 14 while at the opposite end there is an interlocking projection 16. The projection 16 is profiled to be received in the recess 14 as can readily be seen from FIGS. 3 and 4. It will be appreciated that other end profiles, for example, multiple projections and recesses or a hermaphroditic profile, could be used.

Referring to FIGS. 2 to 4, the subject interlocking crimp sleeve 10 as shown as it would be applied to join a braided shield 18 of an electrical cable 20 to a metallic shelf 22 enclosing a known electrical connector (not shown). Since the sleeve 10 is made of a relatively soft metal it can be readily formed from the flat strip of FIG. 1 to the initial curled configuration of FIG. 2 for applying to the cable and connector. The strip is then further deformed, as shown in FIG. 3, to interengage the locking end portions 14, 16. The thus formed crimp sleeve is then crimped in a tool 24, 26, such as shown in FIGS. 5 and 6, to completely form the sleeve into a substantially cylindrical configuration and then apply crimps 28, 30 therein to place the interlocking end portions 14, 16 under tension and assure their continued gripping while reducing the overall diameter of the sleeve so as to achieve the necessary compression for good interconnection between the braid 18 and shell 22. The metal is not so soft that there would be any possibility of the sharp crimps 28, 30 pulling out and releasing the braid from the metal shell.

It should be noted that while reference was made to the particular usefulness of the subject invention in effecting repair of a terminated cable and connector, it is equally useful with regard to making the original assembly. It's scope likewise should not be limited to making interconnection between the shielding of a cable and the shielding of a connector as it could also be used to effect a strain relief securing of a cable to a connector.

I claim:

1. In combination with an electrical connector having a housing of insulative material with a plurality of terminal passages extending therethrough, a like plurality of electrical terminals each mounted in a respective passage, a multi conductor cable having each conductor thereof secured to a respective terminal, and a crimp sleeve capable of being applied to the cable other than axially from a free end and of being crimped to secure said cable to said connector, said crimp sleeve characterized by:

an elongated strip of soft metal having interlocking profiles on the opposite ends thereof whereby said strip is applied to a previously terminated cable by folding it about said cable, interlocking said end profiles to form a substantially closed cylindrical crimp sleeve coaxially on said cable and crimping said sleeve to reduce the diameter thereof placing said interlocked ends under tension and said cable and connector under compression securing said cable to said connector.

2. An interlocking crimping sleeve according to claim 1 wherein:

one end of said strip has at least one profiled projection; and the opposite end of said strip has a like number of recesses each profiled and aligned to receive a respective projection therein.

3. An interlocking crimping sleeve according to claim 1 wherein:

said ends of said strip have a hermaphroditic profile.

4. An interlocking crimping sleeve according to claim 1 wherein:

said soft metal is copper in the range of 0 to 2 on a hardness scale of 12 wherein 0 is annealed, 2 is $\frac{1}{4}$ hard, 4 is $\frac{1}{2}$ hard, 6 is $\frac{3}{4}$ hard, 8 is full hard, and 12 is tempered.

5. The method of securing a cable to a connector which has been preterminated by the cable comprising the steps of:

forming a strip of relatively soft metal with interengaging profiles on the opposite ends thereof;

folding said strip about said cable bringing said opposite ends into interlocking engagement to form substantially a closed cylindrical sleeve; and crimping said sleeve so as to apply tensile force to said interlocked ends and compressive force to said cable against said connector.

6. A method according to claim 5 wherein said sleeve crimpingly secures a shielding layer of a shielded cable to a shield portion of a shielded connector.

* * * * *